US006662593B1

(12) United States Patent
Higginbotham et al.

(10) Patent No.: US 6,662,593 B1
(45) Date of Patent: Dec. 16, 2003

(54) PROCESS AND APPARATUS FOR THE CRYOGENIC SEPARATION OF AIR

(75) Inventors: Paul Higginbotham, Guildford (GB); Rakesh Agrawal, Emmaus, PA (US); Adam Adrian Brostow, Emmaus, PA (US); Kelvin Graham Hayes, East Horsley (GB); Donn Michael Herron, Fogelsville (GB); Declan Patrick O'Connor, Chessington (GB)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/317,593

(22) Filed: Dec. 12, 2002

(51) Int. Cl.[7] ..... F25J 3/04
(52) U.S. Cl. ..... 62/643; 62/925
(58) Field of Search ..... 62/646, 643, 925

(56) References Cited

U.S. PATENT DOCUMENTS 5,067,976 A * 11/1991 Agrawal et al. ..... 62/648
5,425,241 A 6/1995 Agrawal et al. ..... 62/22
5,934,104 A * 8/1999 Fidkowski et al. ..... 62/643
6,196,024 B1 * 3/2001 Ha ..... 62/643

FOREIGN PATENT DOCUMENTS

GB 2346205 A * 2/2000
GB 2346205 8/2000 ..... F25J/3/04

* cited by examiner

*Primary Examiner*—William C. Doerrler
(74) *Attorney, Agent, or Firm*—Willard Jones, II

(57) ABSTRACT

Liquid oxygen ("LOX") product and a krypton- and xenon-enriched liquid product is produced from the cryogenic separation of air using a cryogenic distillation system. The process comprises separating feed air in the main distillation system into nitrogen-rich overhead vapor and said krypton- and xenon-enriched liquid product. At least a portion of said krypton- and xenon-enriched liquid product is removed from the main distillation system for further distillation, to produce at least one krypton- and/or xenon-rich product. Xenon-lean liquid is fed to the first additional distillation column and separated into oxygen-rich overhead vapor and said LOX product having a concentration of xenon less than that in said feed air. The xenon-lean liquid is usually also lean in krypton.

24 Claims, 2 Drawing Sheets

PROCESS AND APPARATUS FOR THE CRYOGENIC SEPARATION OF AIR

BACKGROUND OF THE INVENTION

The present invention relates generally to the field of cryogenic air separation and has particular reference to the production of liquid oxygen ("LOX") and the enhanced recovery of krypton and xenon.

Krypton and xenon are present in air at very low concentrations, typically about 1.14 parts per million ("ppm") and about 0.087 ppm respectively. They are both valuable gases and, thus, there is an economic incentive to maximise their recovery in an air separation process.

In typical air separation processes, krypton and xenon concentrate in the LOX product taken from the bottom of the low pressure distillation column ("LP column") as they are far less volatile than oxygen. The smaller the LOX flow, therefore, the more concentrated the krypton and xenon in this product.

In air separation processes in which most of the oxygen product is removed from the LP column in the gas phase, it is possible to make sure that very little krypton and xenon is lost in the gaseous oxygen ("GOX") by removing the GOX several distillation stages above the bottom of the LP column. Almost all of the krypton and xenon entering the air separation plant can then be recovered in the LOX product, which is a very small proportion of the total oxygen flow. This LOX product can then be processed further to produce a krypton and xenon product.

If the LOX flow from the distillation process is much greater, for example when all the oxygen is withdrawn from the distillation column as LOX, pumped to the required pressure and evaporated in the main heat exchanger, the loss of krypton and xenon is much greater, even when the LOX is taken several stage up the LP column, separately from the krypton- and xenon-concentrated liquid stream. Essentially all of the krypton and xenon entering the air separation plant flows down the LP column to the sump of the LP column in the descending liquid, so any liquid withdrawal will remove a portion of the krypton and xenon proportional to the total liquid withdrawn as product. This will typically lead to losses of about 30% of these valuable products.

It is desirable, therefore, to increase the recovery of krypton and xenon from an air separation plant in which at least part of the oxygen product is withdrawn as LOX.

U.S. Pat. No. 5,425,241 (Agrawal et al; published on Jun. 20, 1995) discloses a cryogenic air separation process in which an ultra-high purity oxygen product is produced in an auxiliary stripping column. A first oxygen-containing stream (essentially free of heavier contaminants such as krypton and xenon) is removed from the main distillation column and fed to the top of the auxiliary stripping column. It is stated that this stream can be liquid, vapor or a combination of both. A second oxygen-containing stream (essentially free of lighter contaminants such as nitrogen and argon) is removed from the main distillation column and is used to provide the stripping gas in the auxiliary stripping column. Ultra-high purity oxygen is removed from an intermediate location in the auxiliary stripping column. LOX (having a total contaminant concentration of generally less than 5%) is removed from the LP column. The fate of this product is not disclosed.

GB-A-2346205 (Rathbone; published on Aug. 2, 2000) discloses the production of a krypton/xenon-enriched LOX stream and a high purity LOX stream from a cryogenic air separation process co-producing an argon product. Air is separated in a double column distillation system comprising a high pressure distillation column ("HP column") thermally integrated with an LP column. It is disclosed that a krypton- and xenon-containing LOX stream is withdrawn from the LP column and may be passed to a storage vessel and taken as desired from the storage vessel for further purification by conventional means so as to produce relatively pure krypton and xenon products. It is also disclosed that an argon-oxygen (but krypton- and xenon-lean) vapor stream is taken from the LP column and separated in a further rectification column into an argon-vapor fraction and an argon-enriched liquid fraction. The argon-enriched liquid fraction is fed to an argon-stripping column to produce a relatively pure LOX fraction. In this process, argon must be separated to be able to achieve a high recovery of krypton and xenon. Furthermore, the teaching of GB-A-2346205 requires that the rare gas lean stream withdrawn from the LP column be a vapour lean in nitrogen and that there be two additional rectification steps in order to obtain a purified oxygen product lean in krypton-xenon. These restrictions add to the cost of obtaining the said purified oxygen stream.

It is desirable, therefore, to provide an air separation process that is able to produce a krypton- and xenon-enriched LOX product for further processing and a pure LOX product without the capital expense and running costs of an argon stripping column.

BRIEF SUMMARY OF THE INVENTION

According to a first aspect of the present invention, there is provided a process for the production of liquid oxygen ("LOX") product and a krypton- and xenon-enriched liquid product from the cryogenic separation of air using a cryogenic distillation system comprising a main distillation system and at least a first additional distillation column, said process comprising:

separating feed air in said main distillation system into nitrogen-rich overhead vapor and said krypton- and xenon-enriched liquid product;

removing at least a portion of said krypton- and xenon-enriched liquid product from said main distillation system for further processing to produce at least one krypton- and/or xenon-rich product;

feeding xenon-lean liquid removed from or derived from liquid removed from said main distillation system to said first additional distillation column; and separating said portion of xenon-lean liquid in said first additional distillation column into oxygen-rich overhead vapor and said LOX product having a concentration of xenon less than that in said feed air.

The expression "krypton- and xenon-enriched product" is intended to mean that the product has concentrations of krypton and xenon that are greater than their respective concentrations in air. In addition, the expression "xenon-lean liquid" is intended to mean that the liquid has a xenon concentration of less than that in air. The xenon-lean liquid is usually also lean in krypton, i.e. has a krypton concentration of less that that in air.

Producing the LOX product from a xenon-lean liquid taken from the main distillation system has the advantage that the LOX product may be produced from the liquid in a single separation step. The present invention does not require the presence of an additional argon separation step producing an argon product to provide a high recovery of krypton and xenon. In addition, it does not require that the xenon-lean liquid be lean in nitrogen also (as required in GB-A-2346205) which allows greater flexibility in selecting the source of the xenon-lean liquid.

Preferably, the process further comprises further processing said krypton- and xenon-enriched liquid product to produce at least one product selected from the group consisting of a krypton-rich product, a xenon-rich product and a krypton- and xenon-rich product. Any known process may be employed for this further processing step such as distillation, adsorption or membrane separation.

In preferred embodiments where the main distillation system comprises at least a high pressure ("HP") distillation column and a low pressure ("LP") distillation column, said columns being thermally integrated via a reboiler/condenser, the process further comprises:

separating feed air in the HP column into nitrogen-enriched overhead vapor and crude liquid oxygen ("CLOX") bottoms liquid;

feeding at least a portion of said CLOX bottoms liquid to said LP column after pressure adjustment;

separating said CLOX bottoms liquid in the LP column into said nitrogen-rich overhead vapor and said krypton- and xenon-enriched liquid product;

condensing at least a portion of said nitrogen-enriched overhead vapor in said reboiler/condenser by indirect heat exchange against krypton- and xenon-enriched liquid product to produce condensed nitrogen-enriched overhead vapor;

feeding at least a portion of said condensed nitrogen-enriched overhead vapor to the HP column as reflux; and feeding liquid from or derived from the HP column to the LP column as reflux after pressure adjustment.

The xenon-lean liquid may be removed from or derived from liquid removed from the LP column or the HP column.

In embodiments wherein the xenon-lean liquid is derived from liquid removed from the HP column, the cryogenic distillation system may further comprise a second additional distillation column and the process further comprises:

removing xenon-depleted liquid from the HP column and feeding at least a portion of said liquid to said second additional distillation column;

separating xenon-depleted liquid in said second additional distillation column into oxygen-enriched overhead vapor and said xenon-lean liquid;

removing xenon-lean liquid from said second additional distillation column and feeding at least a portion of said liquid, after pressure adjustment, to said first additional distillation column for separation into said oxygen-rich overhead vapor and said LOX product.

The expression "xenon-depleted liquid" is intended to mean liquid having a xenon concentration that is less than that in air. The xenon-depleted liquid is usually also depleted in krypton, i.e. has a krypton concentration of less that that in air. The concentrations of krypton and xenon in the xenon-depleted liquid are not necessarily equal to their concentrations in the xenon-lean liquid.

Preferably, the xenon-depleted liquid is substantially free of krypton and xenon.

At least a portion of the oxygen-enriched overhead vapor is usually fed to the HP column.

In embodiments using a second additional distillation column, krypton- and xenon-depleted vapor preferably is fed from the HP column to the second additional distillation column as stripping gas.

In preferred embodiments of the invention, krypton and xenon-lean vapor is fed from the main distillation system to the first additional distillation column as stripping gas. In such embodiments, the first additional distillation column is preferably operated substantially at the pressure of the krypton- and xenon-lean vapor.

Krypton- and xenon-rich vapor may be removed from the main distillation system and fed to the first additional distillation column. The LOX product may then be removed from an intermediate location in the first additional distillation column and bottoms liquid from the first additional distillation column may then be fed to the main distillation system.

A portion of the LOX product may be boiled by indirect heat exchange against a condensing process stream in a reboiler/condenser provided in the first additional distillation column to produce stripping gas.

In preferred embodiments, argon is not separated from said xenon-lean liquid in a separate argon-stripping column. However, an argon-stripping column may be included in the apparatus and the process may then further comprise removing the xenon-lean liquid from liquid feed to the argon-stripping column. Alternatively, a conventional argon column fed by an oxygen-argon vapour from the LP column could be included, if desired.

The concentration of krypton in the xenon-lean liquid is preferably from about 0.0 ppm to about 0.5 ppm and typically about 0.2 ppm. The concentration of xenon in the xenon-lean liquid is preferably from about 0.0 parts per billion ("ppb") to about 20 ppb and typically about 10 ppb.

Gaseous oxygen ("GOX") may be removed from the main distillation system as a minor product.

In a preferred process for the production of liquid oxygen ("LOX") product and a krypton- and xenon-enriched liquid product from the cryogenic separation of air using a cryogenic distillation system comprising at least an HP column and an LP column, said columns being thermally integrated via a reboiler/condenser and at least a first additional distillation column, the process comprises:

separating feed air in the HP column into nitrogen-enriched overhead vapor and crude liquid oxygen ("CLOX") bottoms liquid;

feeding at least a portion of said CLOX bottoms liquid to said LP column after pressure adjustment;

separating said CLOX bottoms liquid in the LP column into nitrogen-rich overhead vapor and krypton- and xenon-enriched liquid product;

condensing at least a portion of said nitrogen-enriched overhead vapor in said reboiler/condenser by indirect heat exchange against krypton- and xenon-enriched liquid product to produce condensed nitrogen-enriched overhead vapor;

feeding at least a portion of said condensed nitrogen-enriched overhead vapor to the HP column as reflux; and feeding liquid from or derived from the HP column to the LP column as reflux after pressure adjustment;

removing at least a portion of said krypton- and xenon-enriched liquid product from said LP column for further processing to produce at least one krypton- and/or xenon-rich product.

removing xenon-lean liquid from said LP column and feeding said liquid to said first additional distillation column; and separating said portion of xenon-lean liquid in said first additional distillation column into oxygen-rich overhead vapor and said LOX product having a concentration of xenon less than that in said feed air.

In another preferred process for the production of liquid oxygen ("LOX") product and a krypton- and xenon-enriched liquid product from the cryogenic separation of air using a cryogenic distillation system comprising at least an HP column and an LP column, said columns being thermally integrated via a reboiler/condenser and at least a first additional distillation column, the process comprises:

separating feed air in the HP column into nitrogen-enriched overhead vapor and crude liquid oxygen ("CLOX") bottoms liquid;

feeding at least a portion of said CLOX bottoms liquid to said LP column after pressure adjustment;

separating said CLOX bottoms liquid in the LP column into nitrogen-rich overhead vapor and said krypton- and xenon-enriched liquid product;

condensing at least a portion of said nitrogen-enriched overhead vapor in said reboiler/condenser by indirect heat exchange against krypton- and xenon-enriched liquid product to produce condensed nitrogen-enriched overhead vapor;

feeding at least a portion of said condensed nitrogen-enriched overhead vapor to the HP column as reflux; and feeding liquid from or derived from the HP column to the LP column as reflux after pressure adjustment;

removing at least a portion of said krypton- and xenon-enriched liquid product from said LP column for further processing to produce at least one krypton- and/or xenon-rich product;

feeding xenon-lean liquid removed from or derived from liquid removed from said HP column to said first additional distillation column; and separating said portion of xenon-lean liquid in said first additional distillation column into oxygen-rich overhead vapor and said LOX product having a concentration of xenon less than that in said feed air.

According to a second aspect of the present invention, there is provided apparatus for the production of LOX product and a krypton- and xenon-enriched product according to the process of the first aspect, said apparatus comprising:

a main distillation system for separating feed air into nitrogen-rich overhead vapor and said krypton- and xenon-enriched liquid product;

a first additional distillation column for separating xenon-lean liquid removed from or derived from liquid removed from said main distillation system into oxygen-rich overhead vapor and said LOX product; and conduit means for feeding said xenon-lean liquid from said main distillation system to said first additional distillation column.

The main distillation system preferably comprises an HP column and an LP column, said columns being thermally integrated via a reboiler/condenser.

The apparatus may further comprise:

a second additional distillation column for separating xenon-depleted liquid into oxygen-enriched overhead vapor and said xenon-lean liquid;

conduit means for feeding xenon-depleted liquid from the HP column to the second additional distillation column; and conduit means for feeding xenon-lean liquid from the second additional distillation column to said first additional distillation column.

DETAILED DESCRIPTION OF THE INVENTION

Figure 1:
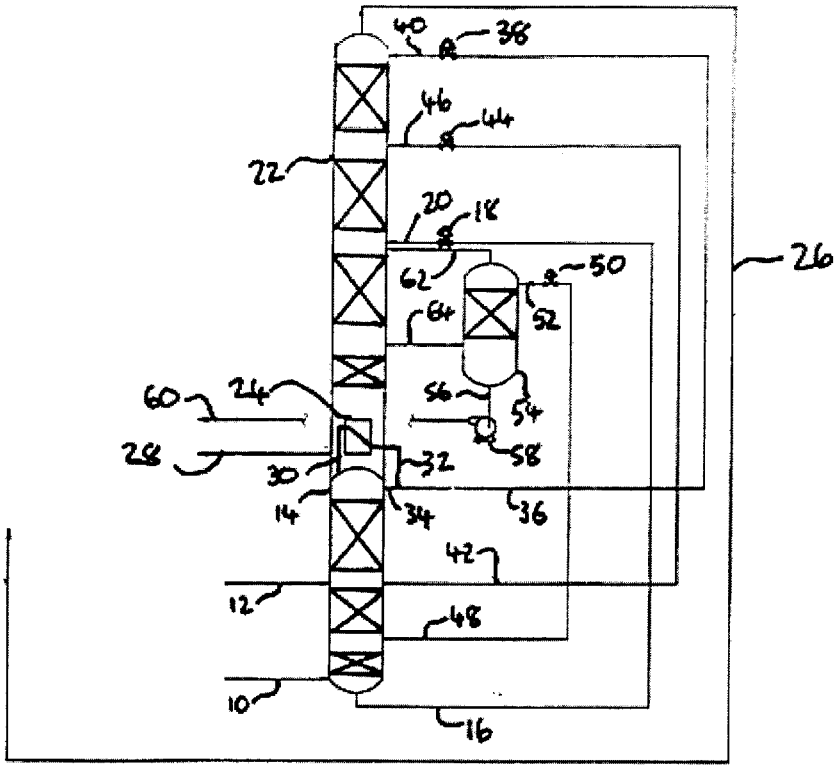
FIG. 1 is a schematic representation of an embodiment of the present invention in which a xenon-lean liquid for the first additional distillation column is removed from the HP column at a location below the top-most air feed to the HP column.

Referring now to FIG. 1, a stream 10 of cooled, compressed air and a stream 12 of liquefied air are fed to a HP column 14 where the air is separated into nitrogen-enriched overhead vapor and CLOX bottoms liquid. A stream 16 of CLOX bottoms liquid is reduced in pressure across a valve 18 and is fed as stream 20 to an LP column 22 that is thermally integrated with the HP column 14 via reboiler/condenser 24 provided in the sump of the LP column 22. The CLOX bottoms liquid is separated in the LP column 22 into nitrogen-rich overhead vapor and krypton- and xenon-enriched liquid product. A stream 26 of nitrogen-rich overhead vapor is removed from the LP column 22. The majority of the krypton and xenon from the air collects as liquid in the sump of the LP column 22. Krypton- and xenon-enriched liquid product is removed as stream 28 for further processing into krypton and xenon products.

A stream 30 of HP nitrogen-enriched overhead vapor is condensed in the reboiler/condenser 24 by indirect heat exchange with krypton- and xenon-enriched liquid in the LP column 22 to produce a stream 32 of condensed HP nitrogen-enriched overhead vapor which is divided into two streams 34, 36. Stream 34 is fed to the top of the HP column 14 as reflux for the HP column 14. Stream 36 is reduced in pressure across a valve 38 and the reduced pressure stream 40 fed as reflux to the top of the LP column 22. A stream 42 of liquid taken from an intermediate location in the HP column 14 is reduced in pressure across a valve 44 and fed as stream 46 to the LP column 22.

A krypton- and xenon-lean liquid stream 48 is removed from an intermediate location in the HP column 14 between the locations at which feed air streams 10, 12 are introduced and is reduced in pressure across a valve 50 and is fed as stream 52 to a first additional distillation column 54 where it is separated into oxygen-enriched overhead and LOX product which is substantially pure LOX. A stream 56 of LOX product removed from the first additional distillation column 54, pumped in a pump 58 to the required pressure to produce a stream 60 of pressurised LOX product. A stream 62 of oxygen-enriched overhead vapor is removed from to top of the first additional distillation column 54 and is fed without pressure adjustment to the LP column 22 at an appropriate location, usually at or near the same location as the CLOX feed stream 20 to the LP column 22. Stripping gas for the first additional distillation column is provided by a stream 64 of krypton- and xenon-lean vapor taken from an intermediate location in the LP distillation column 22 below the CLOX feed stream 20 from the HP column 14.

Figure 2:
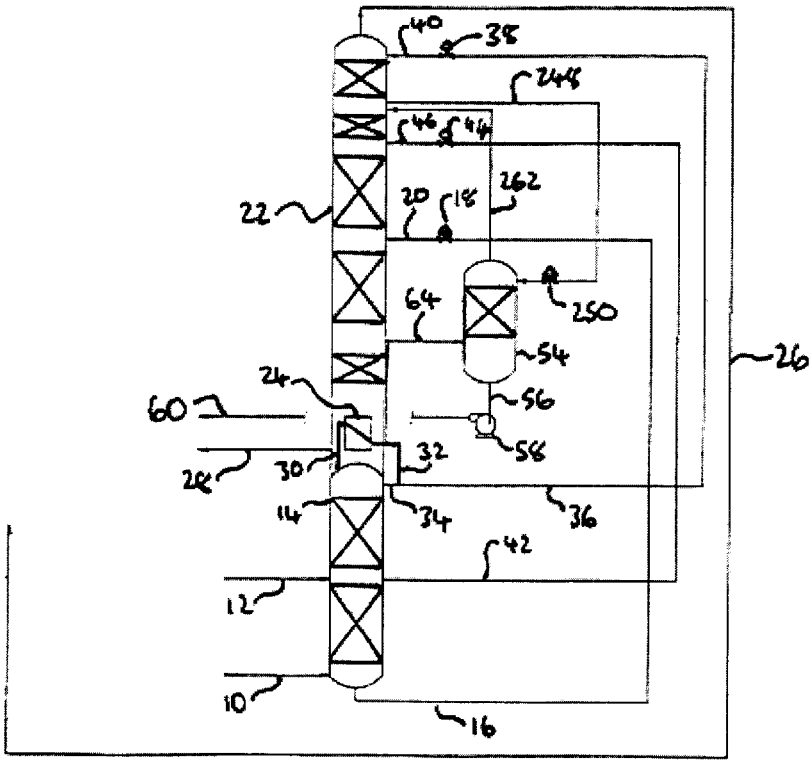
FIG. 2 is a schematic representation of another embodiment of the present invention in which a xenon-lean liquid for the first additional distillation column is removed from the LP column.
Figure 3:
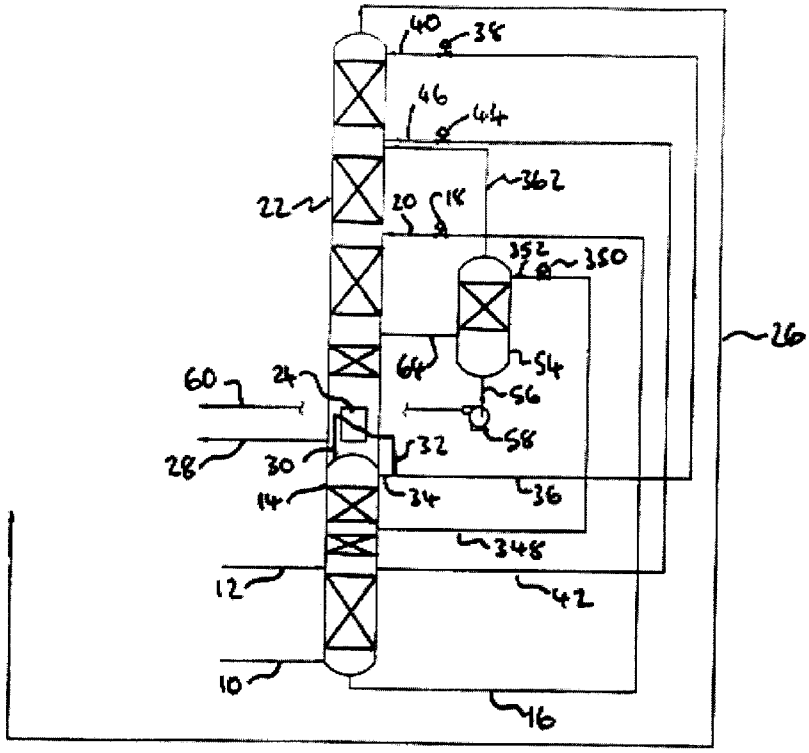
FIG. 3 is a schematic representation of a further embodiment of the present invention in which a xenon-lean liquid for the first additional distillation column is removed from the HP column at a location above the top-most air feed to the HP column.
Figure 4:
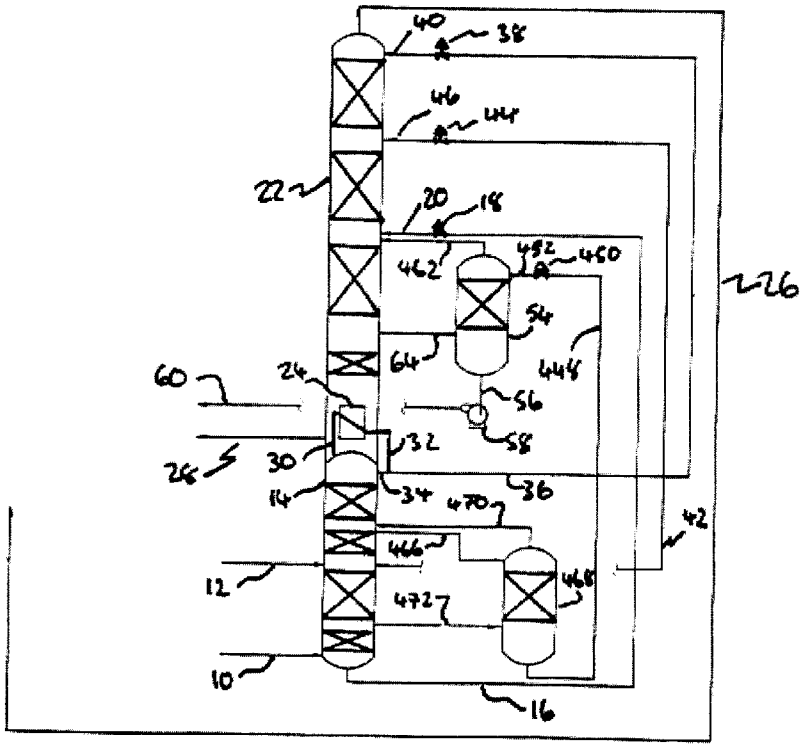
FIG. 4 is a schematic representation of a yet further embodiment of the present invention in which a xenon-lean liquid for the first additional distillation column is removed from a second additional distillation column fed from the HP column.

The same numerical legends have been used in FIGS. 2 to 4 to represent the features of the processes depicted therein that are common to the process depicted in FIG. 1. The processes of FIGS. 2 to 4 will only be described in detail in respect of the modifications over the process depicted in FIG. 1.

Referring now to FIG. 2, a stream 248 of krypton- and xenon-lean liquid is removed from a location in the LP column 22 above the location at which liquid stream 46 is fed to the LP column 22. The krypton- and xenon-lean stream 248 is fed via flow control valve 250 to the first additional distillation column 54. A stream 262 of oxygen-enriched overhead vapor is removed from the first additional distillation column and fed without pressure adjustment to the LP column 22 at a location at an appropriate location, usually at or near the location of removal of the krypton- and xenon-lean stream 248. Another krypton- and xenon-lean vapor stream could also be fed from the LP column 22 to the first additional distillation column 54 from the location where the CLOX stream 20 is fed to increase the efficiency of the distillation.

Alternatively, liquid stream 42 may be withdrawn from the HP column 14 at least one stage above the location at which liquid air stream 12 is fed to the HP column 14. In this case, stream 42 becomes a krypton and xenon-lean liquid thus allowing for stream 248 to be withdrawn from the LP column 22 below the feed location of stream 46 and at least one stage above the feed location of the CLOX stream 20 in the LP column 22. The vapor stream 262 is then returned to the LP column 22 at an appropriate location, usually at or near the same location as the CLOX feed stream 20 to the LP column 22.

Referring now FIG. 3, a stream 348 of krypton- and xenon-lean liquid is removed from a location in the HP column 14 above the location at which the top-most feed air stream 12 is introduced to the HP column 14. Stream 348 is reduced in pressure across valve 350 and then fed to the first additional distillation column 54 as stream 352. A stream 362 of oxygen-enriched overhead vapor is removed from the top of the first additional distillation column 54 and fed without pressure adjustment to an appropriate location of the LP column 22, usually an intermediate location at or near the location at which liquid stream 46 is introduced into the LP column 22.

Referring now to FIG. 4, a stream 466 of krypton- and xenon-depleted liquid is removed from a location in the HP column 14 above the location of at which the top-most feed air stream 12 of liquefied air is introduced to the HP column 14. Stream 466 is fed to a second additional distillation column 468 where it is separated into oxygen-enriched overhead vapor and krypton- and xenon-lean liquid. A stream 448 of krypton- and xenon-lean liquid is removed from the second additional distillation column 468, reduced in pressure across valve 450 and fed as stream 452 to the first additional distillation column 54. A stream 462 of oxygen-enriched overhead vapor from the first additional distillation column 54 is fed without pressure adjustment to an appropriate location of the LP column 22, usually at or near the location at which the CLOX stream 20 is fed to the LP column 22.

A stream 470 of oxygen-enriched overhead vapor is removed from the top of the second additional distillation column 468 and fed without pressure adjustment to the HP column 14 at a location at or near the location of removal of the krypton- and xenon-depleted stream 466. A stream 472 of krypton- and xenon-depleted vapor is removed from an intermediate location in the HP column 14 between the locations at which the compressed air feed streams 10, 12 are introduced into the HP column 14. Stripping gas for the second additional distillation column 468 is provided by stream 472.

In the processes depicted in FIGS. 1 to 4, it is possible to add a reboiler/condenser to the bottom of the first additional column 54 to replace at least a portion of the vapor flow provided by stream 64. In these processes, it is also possible to feed a krypton- and xenon-rich vapor to the bottom of the first additional distillation column 54 in place of the krypton- and xenon-lean vapor stream 64. In this case, the LOX product may be taken several distillation stages above the bottom of column 54 and the bottoms liquid returned to the bottom of the LP column 22.

In the processes depicted in each figure, it is possible to add a subcooler to subcool liquids from the HP column 14 before reducing them in pressure and feeding them to either the LP column 22 or the first additional distillation column 54.

Throughout the specification, the term "means" in the context of means for carrying out a function is intended to refer to at least one device adapted and/or constructed to carry out that function.

It will be appreciated that the invention is not restricted to the details described above with reference to the preferred embodiments but that numerous modifications and variations can be made without departing from the spirit and scope of the invention as defined by the following claims.

What is claimed is:

1. A process for the production of liquid oxygen ("LOX") product and a krypton- and xenon-enriched liquid product from a cryogenic separation of air using a cryogenic distillation system comprising a main distillation system and at least a first additional distillation column, said process comprising:

separating feed air in said main distillation system into nitrogen-rich overhead vapor and said krypton- and xenon-enriched liquid product;

removing at least a portion of said krypton- and xenon-enriched liquid product from said main distillation system for further processing to produce at least one krypton- and/or xenon-rich product;

feeding xenon-lean liquid removed from or derived from liquid removed from said main distillation system to said first additional distillation column; and separating said portion of xenon-lean liquid in said first additional distillation column into oxygen-rich overhead vapor and said LOX product having a concentration of xenon less than that in said feed air.

2. The process of claim 1 further comprising further processing said krypton- and xenon-enriched liquid product to produce at least one product selected from the group consisting of a krypton-rich product, a xenon-rich product and a krypton- and xenon-rich product.

3. The process of claim 1 wherein the main distillation system comprises at least a high pressure ("HP") distillation column and a low pressure ("LP") distillation column, said columns being thermally integrated via a reboiler/condenser, said process further comprising:

separating feed air in the HP column into nitrogen-enriched overhead vapor and crude liquid oxygen ("CLOX") bottoms liquid;

feeding at least a portion of said CLOX bottoms liquid to said LP column after pressure adjustment;

separating said CLOX bottoms liquid in the LP column into said nitrogen-rich overhead vapor and said krypton- and xenon-enriched liquid product;

condensing at least a portion of said nitrogen-enriched overhead vapor in said reboiler/condenser by indirect heat exchange against krypton- and xenon-enriched liquid product to produce condensed nitrogen-enriched overhead vapor;

feeding at least a portion of said condensed nitrogen-enriched overhead vapor to the HP column as reflux; and feeding liquid from or derived from the HP column to the LP column as reflux after pressure adjustment.

4. The process of claim 3 wherein said xenon-lean liquid is removed from or derived from liquid removed from the LP column.

5. The process of claim 3 wherein said xenon-lean liquid is removed from or derived from liquid removed from the HP column.

6. The process of claim 5 wherein the cryogenic distillation system further comprises a second additional distillation column, said process further comprising:

removing xenon-depleted liquid from the HP column and feeding at least a portion of said liquid to said second additional distillation column;

separating xenon-depleted liquid in said second additional distillation column into oxygen-enriched overhead vapor and said xenon-lean liquid;

removing xenon-lean liquid from said second additional distillation column and feeding at least a portion of said liquid, after pressure adjustment, to said first additional distillation column for separation into said oxygen-rich overhead vapor and said LOX product.

7. The process of claim 6 wherein the xenon-depleted liquid is substantially free of krypton and xenon.

8. The process of claim 6 wherein at least a portion of the oxygen-enriched overhead vapor is fed to the HP column.

9. The process of claim 6 wherein krypton- and xenon-depleted vapor is fed from the HP column to the second additional distillation column as stripping gas.

10. The process of claim 1 wherein krypton and xenon-lean vapor is fed from the main distillation system to the first additional distillation column as stripping gas.

11. The process of claim 10 wherein the first additional distillation column is operated substantially at the pressure of the krypton- and xenon-lean vapor.

12. The process of claim 1 further comprising:

removing krypton- and xenon-rich vapor from the main distillation system and feeding said vapor to the first additional distillation column;

removing said LOX product from an intermediate location in the first additional distillation column; and feeding bottoms liquid from the first additional distillation column to the main distillation system.

13. The process of claim 1 wherein a portion said LOX product is boiled by indirect heat exchange against a condensing process stream in a reboiler/condenser provided in the first additional distillation column to produce stripping gas.

14. The process of claim 1 wherein argon is not separated from said xenon-lean liquid.

15. The process of claim 1 wherein argon is separated in an argon stripping column, said process further comprising removing said xenon-lean liquid from liquid feed to said argon-stripping column.

16. The process of claim 1 wherein the krypton- and xenon-enriched liquid product is further processed using at least one of the separation methods in the group consisting of distillation, adsorption or membrane separation.

17. The process of claim 1 wherein the concentration of krypton in the xenon-lean liquid is from about 0.0 ppm to about 0.5 ppm.

18. The process of claim 1 wherein the concentration of xenon in the xenon-lean liquid is from about 0.0 ppb to about 20 ppb.

19. The process of claim 1 wherein gaseous oxygen ("GOX") is removed from the main distillation system as a minor product.

20. A process for the production of liquid oxygen ("LOX") product and a krypton- and xenon-enriched liquid product from the cryogenic separation of air using a cryogenic distillation system comprising at least an HP column and an LP column, said columns being thermally integrated via a reboiler/condenser, and at least a first additional distillation column, said process comprising:

separating feed air in the HP column into nitrogen-enriched overhead vapor and crude liquid oxygen ("CLOX") bottoms liquid;

feeding at least a portion of said CLOX bottoms liquid to said LP column after pressure adjustment;

separating said CLOX bottoms liquid in said LP column into nitrogen-rich overhead vapor and said krypton- and xenon-enriched liquid product;

condensing at least a portion of said nitrogen-enriched overhead vapor in said reboiler/condenser by indirect heat exchange against krypton- and xenon-enriched liquid product to produce condensed nitrogen-enriched overhead vapor;

feeding at least a portion of said condensed nitrogen-enriched overhead vapor to the HP column as reflux; and feeding liquid from or derived from the HP column to the LP column as reflux after pressure adjustment;

removing at least a portion of said krypton- and xenon-enriched liquid product from said LP column for further processing to produce at least one krypton- and/or xenon-rich product;

removing xenon-lean liquid from said LP column and feeding said liquid to said first additional distillation column; and separating said portion of xenon-lean liquid in said first additional distillation column into oxygen-rich overhead vapor and said LOX product having a concentration of xenon less than that in said feed air.

21. A process for the production of liquid oxygen ("LOX") product and a krypton- and xenon-enriched liquid product from the cryogenic separation of air using a cryogenic distillation system comprising at least an HP column and an LP column, said columns being thermally integrated via a reboiler/condenser, and at least a first additional distillation column, said process comprising:

separating feed air in the HP column into nitrogen-enriched overhead vapor and crude liquid oxygen ("CLOX") bottoms liquid;

feeding at least a portion of said CLOX bottoms liquid to said LP column after pressure adjustment;

separating said CLOX bottoms liquid in the LP column into nitrogen-rich overhead vapor and said krypton- and xenon-enriched liquid product;

condensing at least a portion of said nitrogen-enriched overhead vapor in said reboiler/condenser by indirect heat exchange against krypton- and xenon-enriched liquid product to produce condensed nitrogen-enriched overhead vapor;

feeding at least a portion of said condensed nitrogen-enriched overhead vapor to the HP column as reflux; and feeding liquid from or derived from the HP column to the LP column as reflux after pressure adjustment;

removing at least a portion of said krypton- and xenon-enriched liquid product from said LP column for further processing to produce at least one krypton- and/or xenon-rich product;

feeding xenon-lean liquid removed from or derived from liquid removed from said HP column to said first additional distillation column; and separating said portion of xenon-lean liquid in said first additional distillation column into oxygen-rich overhead vapor and said LOX product having a concentration of xenon less than that in said feed air.

22. Apparatus for the production of LOX product and a krypton- and xenon-enriched liquid product according to the process of claim 1, said apparatus comprising:

a main distillation system for separating feed air into nitrogen-rich overhead vapor and said krypton- and xenon-enriched liquid product;

a first additional distillation column for separating xenon-lean liquid removed from or derived from liquid removed from said main distillation system into oxygen-rich overhead vapor and said LOX product; and conduit means for feeding said xenon-lean liquid from said main distillation system to said first additional distillation column.

23. The apparatus of claim 22 wherein the main distillation system comprises an HP column and an LP column, said columns being thermally integrated via a reboiler/condenser.

24. The apparatus of claim 23 further comprising:

a second additional distillation column for separating xenon-depleted liquid into oxygen-enriched overhead vapor and said xenon-lean liquid;

conduit means for feeding xenon-depleted liquid from the HP column to the second additional distillation column; and conduit means for feeding xenon-lean liquid from the second additional distillation column to said first additional distillation column.

* * * * *